US012392112B2

(12) United States Patent
Ito et al.

(10) Patent No.: US 12,392,112 B2
(45) Date of Patent: Aug. 19, 2025

(54) WORK MACHINE STATE MONITORING SYSTEM AND WORK MACHINE STATE MONITORING METHOD

(71) Applicants: KOBELCO CONSTRUCTION MACHINERY CO., LTD., Hiroshima (JP); HIROSHIMA UNIVERSITY, Higashihiroshima (JP)

(72) Inventors: Masaru Ito, Higashihiroshima (JP); Yuichi Kurita, Higashihiroshima (JP)

(73) Assignees: Kobelco Construction Machinery Co., Ltd., Hiroshima (JP); Hiroshima University, Hiroshima (JP)

( * ) Notice: Subject to any disclaimer, the term of this patent is extended or adjusted under 35 U.S.C. 154(b) by 291 days.

(21) Appl. No.: 18/007,818

(22) PCT Filed: May 20, 2021

(86) PCT No.: PCT/JP2021/019270
§ 371 (c)(1),
(2) Date: Dec. 2, 2022

(87) PCT Pub. No.: WO2021/246190
PCT Pub. Date: Dec. 9, 2021

(65) Prior Publication Data

US 2023/0228064 A1 Jul. 20, 2023

(30) Foreign Application Priority Data

Jun. 4, 2020 (JP) ..... 2020-097595

(51) Int. Cl.
*E02F 9/26* (2006.01)
*E02F 3/32* (2006.01)

(52) U.S. Cl.
CPC . *E02F 9/26* (2013.01); *E02F 3/32* (2013.01)

(58) Field of Classification Search
CPC ..... E02F 9/26; E02F 3/32
See application file for complete search history.

(56) References Cited

U.S. PATENT DOCUMENTS 8,768,581 B2 7/2014 Mizuochi et al.
10,534,900 B2 * 1/2020 Cheong ..... G06F 21/34
(Continued)

FOREIGN PATENT DOCUMENTS

JP H10-291779 A 11/1998
JP 2014-122510 A 7/2014
(Continued)

OTHER PUBLICATIONS

Office Action dated Apr. 19, 2024 issued in the corresponding Chinese Patent Application No. 202180040200.8 with the English machine translation thereof.
(Continued)

*Primary Examiner* — Scott A Browne
*Assistant Examiner* — Terry C Buse
(74) *Attorney, Agent, or Firm* — Carrier, Shende & Associates P.C.; Joseph P. Carrier; Jeffrey T. Gedeon

(57) ABSTRACT

A system capable of improving accuracy of information relating to the degree of instability of a work machine such as an excavator, the information being provided to an operator of the work machine. Instability degree information, which indicates instability degrees Is1, Is2 of a base body (lower traveling body 410 and upper turning body 420) for which instability values have been assessed as continuous variables, is output to a remote image output device 221 (information output device) such that the form of the output varies continuously depending on continuous changes in the instability degrees Is1, Is2. An operator of a work machine 40 can highly accurately recognize the closeness of the current instability degree of the base body to a threshold
(Continued)

value at which the base body becomes unstable, and consequently a tolerable range in which the work mechanism, etc. are operated while avoiding instability of the base body.

8 Claims, 13 Drawing Sheets

(56) References Cited

U.S. PATENT DOCUMENTS

| | | | | |
|---|---|---|---|---|
| 10,768,284 | B1 * | 9/2020 | Diehl | H04R 3/04 |
| 2002/0075157 | A1 | 6/2002 | Muller | |
| 2013/0066527 | A1 * | 3/2013 | Mizuochi | E02F 9/24 701/50 |
| 2019/0017248 | A1 | 1/2019 | Okada et al. | |
| 2021/0002862 | A1 * | 1/2021 | Ono | E02F 9/24 |
| 2021/0087794 | A1 | 3/2021 | Yamamoto | |

FOREIGN PATENT DOCUMENTS

| | | | |
|---|---|---|---|
| JP | 2018-003282 | A | 1/2018 |
| JP | 2019-112783 | A | 7/2019 |
| WO | 2011/148946 | A1 | 12/2011 |
| WO | 2019/182042 | A1 | 9/2019 |
| WO | 2019/244574 | A1 | 12/2019 |

OTHER PUBLICATIONS

Office Action dated Aug. 8, 2023 issued in the corresponding Japanese Patent Application No. 2020-097595 with the English machine translation thereof.

The extended European search report dated Sep. 5, 2023 issued in the corresponding EP Patent Application No. 21817657.6.

* cited by examiner

WORK MACHINE STATE MONITORING SYSTEM AND WORK MACHINE STATE MONITORING METHOD

TECHNICAL FIELD

The present invention relates to a system for monitoring a state of a work machine (actual machine).

BACKGROUND ART

There has been proposed an excavator which presents the degree of instability of the excavator to an operator, thereby making it possible to accurately determine an action that is not intended by the operator (see, for example, Patent Literature 1).

CITATION LIST

Patent Literature

Patent Literature 1: Japanese Unexamined Patent Application Publication No. 2019-112783

SUMMARY OF INVENTION

Technical Problem

However, the degree of instability is presented as a discrete variable indicated, for example, in three ranges, and therefore, even when the operator uses the degree of instability as a reference, it is difficult to highly accurately grasp what degree of movement of each of a boom, an arm and a bucket causes a lower traveling body of the excavator to float up. Consequently, despite a situation in which the probability of occurrence of floating of the lower traveling body, i.e., the probability that the excavator becomes unstable is low, there is a possibility that the operator may stop further actions of the boom, etc., and the work efficiency may decrease.

Thus, an object of the present invention is to provide a system, which is provided for an operator of a work machine such as an excavator, and makes it possible to improve the accuracy of information relating to the degree of instability of the work machine.

Solution to Problem

An actual machine state monitoring system of the present invention is for causing an information output device to transmit a state of a work machine to an operator of the work machine, the work machining having a base body, a work mechanism extending from the base body, and a work part attached to a distal end of the work mechanism, the actual machine state monitoring system comprising:

- an actual machine state recognition element which recognizes an attitude of the base body, and an external force acting on the work part;
- an instability degree assessment element which assesses, based on the attitude of the base body and the external force acting on the work part recognized by the actual machine state recognition element, an instability degree of the base body as a continuous variable; and
- an output control element which causes the information output device to output instability degree information such that a form of output of the instability degree information varies continuously depending on a continuous change in the instability degree, the instability degree information indicating the instability degree of the base body assessed by the instability degree assessment element.

According to the actual machine state monitoring system of this configuration, the instability degree information indicating the value of the instability degree of the base body assessed as a continuous variable is output to the information output device such that the form of the output varies continuously depending on a continuous change in the instability degree.

Therefore, it is possible to enable the operator of the work machine to highly accurately recognize the closeness of the current instability degree of the base body to a threshold value at which the base body becomes unstable, and consequently a tolerable range in which the work mechanism, etc. are operated while avoiding instability of the base body.

In order to cause the operator to recognize the instability degree through the operator's sense of vision, the output control element may cause an image output device constituting the information output device to output a diagram showing the instability degree of the base body such that the form of the diagram varies continuously based on a threshold value of the instability degree as a criterion. In order to cause the operator to recognize the instability degree through the operator's sense of hearing, the output control element may cause a sound output device constituting the information output device to output a sound indicating the instability degree of the base body such that volume, frequency, or a combination of the volume and frequency of the sound varies continuously. In order to cause the operator to recognize the instability degree through the operator's sense of touch, the output control element may cause a vibration output device constituting the information output device to output a vibration indicating the instability degree of the base body such that amplitude, vibration frequency, or a combination of the amplitude and vibration frequency of the vibration varies continuously.

The actual machine state monitoring system of the present invention may be constituted by a remote operation assistant server for assisting, based on communications with each of the work machine and a remote operation device for remotely operating the work machine, a remote operation of the work machine by the remote operation device. The information output device may be constituted by the remote operation device for remotely operating the work machine.

DESCRIPTION OF EMBODIMENTS (Configuration of Remote Operating System)

Figure 1:
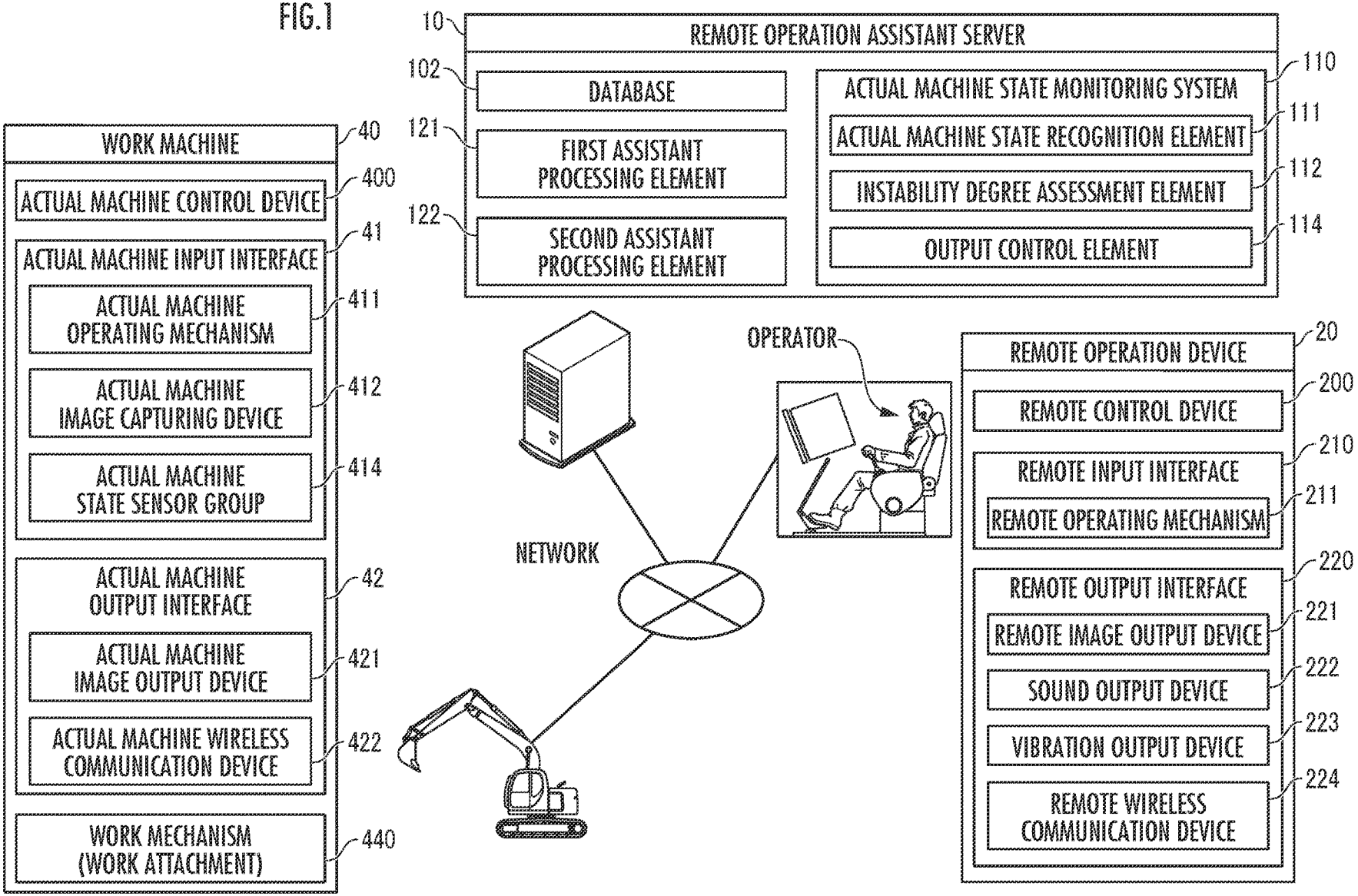
FIG. 1 is an explanatory view about a configuration of an actual machine state monitoring system as an embodiment of the present invention.

An actual machine state monitoring system 110 as an embodiment of the present invention shown in FIG. 1 is constituted by a remote operation assistant server 10 for assisting a remote operation of a work machine 40 by a remote operation device 20. The remote operation assistant server 10 and the remote operation device 20 are configured to be able to communicate with each other through a first network. The remote operation assistant server 10 and the work machine 40 are configured to be able to communicate with each other through a second network. The first network and the second network may be networks adopting the same common communication standard, or networks adopting mutually different communication standards.

(Configuration of Remote Operation Assistant Server)

The remote operation assistant server 10 includes a database 102, the actual machine state monitoring system 110, a first assistant processing element 121, and a second assistant processing element 122. The database 102 stores and retains captured image data, etc. The database 102 may be constituted by a database server different from the remote operation assistant server 10. Each of the assistant processing elements is constituted by an arithmetic processing device (a single-core processor, or a multi-core processor or a processor core constituting the same), reads necessary data and software from a storage device such as a memory, and executes later-described arithmetic processing on the data, according to the software.

(Configuration of Actual Machine State Monitoring System)

The actual machine state monitoring system 110 comprises an actual machine state recognition element 111, an instability degree assessment element 112, and an output control element 114. Each of the elements is constituted by an arithmetic processing device (a single-core processor, or a multi-core processor or a processor core constituting the same), reads necessary data and software from a storage device such as a memory, and executes later-described arithmetic processing on the data, according to the software.

(Configuration of Remote Operation Device)

The remote operation device 20 comprises a remote control device 200, a remote input interface 210, and a remote output interface 220. The remote control device 200 is constituted by an arithmetic processing device (a single-core processor, or a multi-core processor or a processor core constituting the same), reads necessary data and software from a storage device such as a memory, and executes arithmetic processing on the data, according to the software.

The remote input interface 210 comprises a remote operating mechanism 211. The remote output interface 220 comprises a remote image output device 221, a sound output device 222, a vibration output device 223, and a remote wireless communication device 224. Each of the remote image output device 221, the sound output device 222, and the vibration output device 223 constitutes an "information output device". Some of the remote image output device 221, the sound output device 222, and the vibration output device 223 may be omitted.

The remote operating mechanism 211 includes a traveling operating device, a turning operating device, a boom operating device, an arm operating device, and a bucket operating device. Each of the operating devices has an operating lever which receives a pivoting operation. The operating lever (travel lever) of the traveling operating device is operated to move a lower traveling body 410 of the work machine 40. The travel lever may also function as a travel pedal. For example, a travel pedal which is fixed to a base portion or a lower end portion of the travel lever may be provided. The operating lever (turn lever) of the turning operating device is operated to move a hydraulic turning motor constituting a turning mechanism 430 of the work machine 40. The operating lever (boom lever) of the boom operating device is operated to move a boom cylinder 442 of the work machine 40. The operating lever (arm lever) of the arm operating device is operated to move an arm cylinder 444 of the work machine 40. The operating lever (bucket lever) of the bucket operating device is operated to move a bucket cylinder 446 of the work machine 40.

Figure 2:
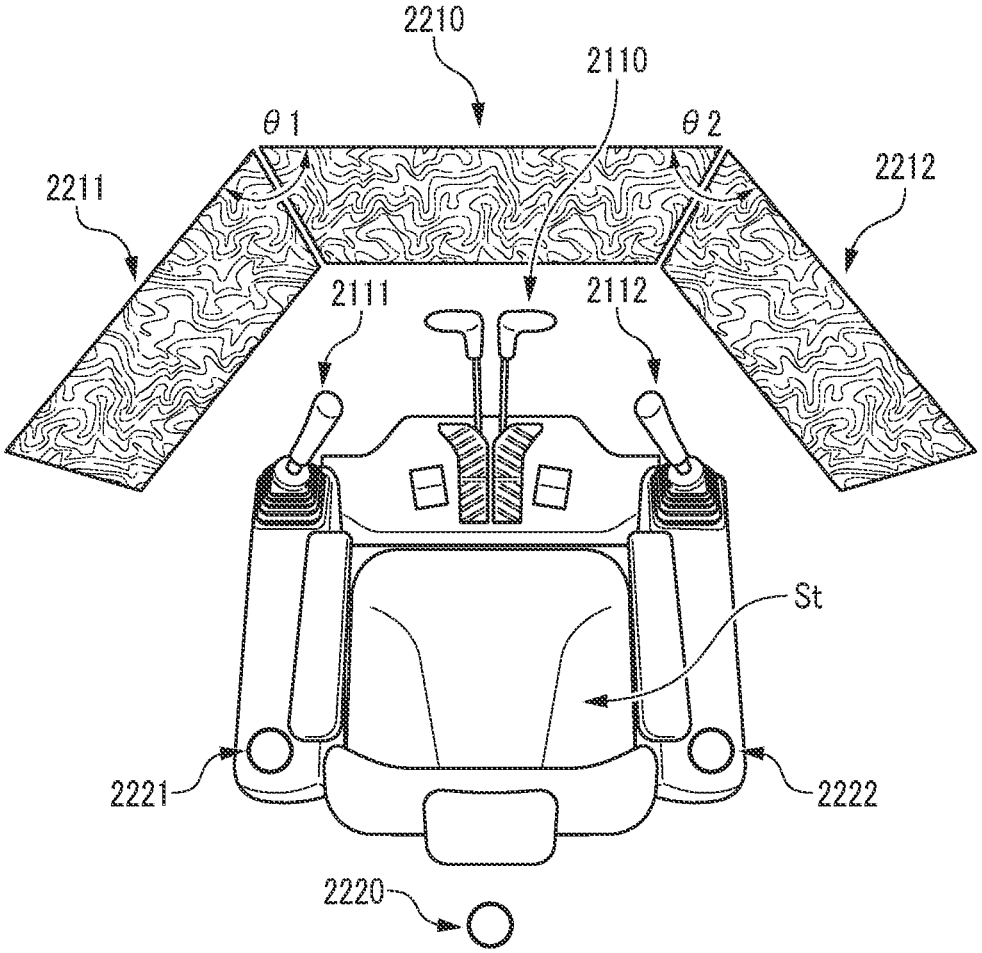
FIG. 2 is an explanatory view about a configuration of a remote operation device.

As shown in FIG. 2, for example, the operating levers constituting the remote operating mechanism 211 are disposed around a seat St on which the operator sits. The seat St is in the form of a high back chair with arm rests, but may be a seat in any form on which the operator can sit, such as a low back chair without a head rest, or a chair without a backrest.

A pair of left and right travel levers 2110 corresponding to left and right crawlers are disposed side by side on the left side and right side in front of the seat St. One operating lever may function as a plurality of operating levers. For example, the left-side operating lever 2111 mounted at the front of a left-side frame of the seat St shown in FIG. 2 may function as an arm lever when the left-side operating lever 2111 is operated in a front-rear direction, and also function as a turn lever when the left-side operating lever 2111 is operated in a left-right direction. Similarly, aright-side operating lever 2112 mounted at the front of a right-side frame of the seat St shown in FIG. 2 may function as a boom lever when the right-side operating lever 2112 is operated in the front-rear direction, and also function as a bucket lever when the right-side operating lever 2112 is operated in the left-right direction. A lever pattern may be arbitrarily changed according to an operation instruction from the operator.

For example, as shown in FIG. 2, the remote image output device 221 is constituted by a central remote image output device 2210, a left-side remote image output device 2211, and a right-side remote image output device 2212 disposed in front, on the diagonally front left side, and the diagonally front right side, respectively, of the seat St, each remote image output device having a substantially rectangular screen. The screens (image display areas) of the central remote image output device 2210, the left-side remote image output device 2211, and the right-side remote image output device 2212 may have the same shape and size, or different shapes and sizes.

As shown in FIG. 2, the right edge of the left-side remote image output device 2211 is adjacent to the left edge of the central remote image output device 2210 such that the screen of the central remote image output device 2210 and the screen of the left-side remote image output device 2211 form an inclination angle θ1 (for example, 120°≤θ1≤150°). As shown in FIG. 2, the left edge of the right-side remote image output device 2212 is adjacent to the right edge of the central remote image output device 2210 such that the screen of the central remote image output device 2210 and the screen of the right-side remote image output device 2212 form an inclination angle θ2 (for example, 120°≤θ2≤150°). The inclination angles θ1 and θ2 may be the same, or different from each other.

The screens of the central remote image output device 2210, the left-side remote image output device 2211, and the right-side remote image output device 2212 may be parallel to a vertical direction, or inclined with respect to the vertical direction. At least one image output device among the central remote image output device 2210, the left-side remote image output device 2211, and the right-side remote image output device 2212 may be constituted by a plurality of split image output devices. For example, the central remote image output device 2210 may be constituted by a pair of image output devices which have substantially rectangular screens and are disposed adjacent to each other in the up-down direction.

The sound output device 222 is constituted by one or a plurality of speakers, and, for example, as shown in FIG. 2, is constituted by a central sound output device 2220, a left-side sound output device 2221, and a right-side sound output device 2222 disposed behind the seat St, behind the left armrest, and behind the right armrest, respectively. The specifications of the central sound output device 2220, the left-side sound output device 2221, and the right-side sound output device 2222 may be the same, or different from each other.

The vibration output device 223 is constituted by a piezoelectric element, and disposed or buried at one or a plurality of points of the seat St. When the vibration output device 223 vibrates, the operator sitting on the seat St can recognize the vibration mode through the sense of touch. The vibration output device 223 may be installed at any place touchable by the operator to recognize vibration, such as a remote operating lever constituting the remote operating mechanism 211.

(Configuration of Work Machine)

The work machine 40 comprises an actual machine control device 400, an actual machine input interface 41, an actual machine output interface 42, and a work mechanism 440. The actual machine control device 400 is constituted by an arithmetic processing device (a single-core processor, or a multi-core processor or a processor core constituting the same), reads necessary data and software from a storage device such as a memory, and executes arithmetic processing on the data, according to the software.

Figure 3:
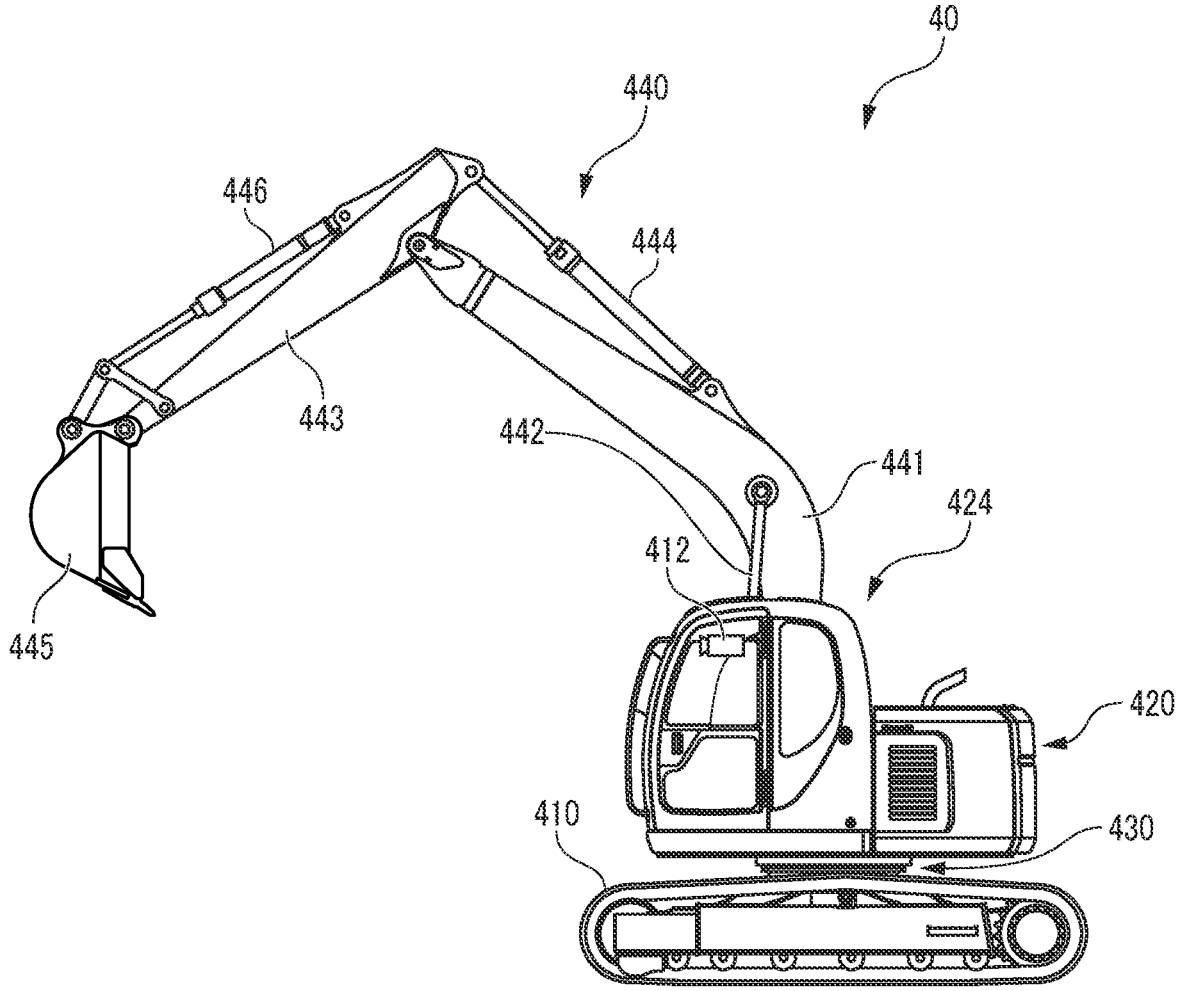
FIG. 3 is an explanatory view about a configuration of a work machine.

The work machine 40 is, for example, a crawler excavator (construction machine) of hydraulic type, electric type, or hybrid driven type produced by a hydraulic-electric combination, and, as shown in FIG. 3, comprises a crawler type lower traveling body 410, and an upper turning body 420 mounted on the lower traveling body 410 via a turning mechanism 430 so as to be able to turn. A cab 424 (driver's cabin) is mounted on the front left side of the upper turning body 420. The work mechanism 440 is mounted at the front center of the upper turning body 420.

The actual machine input interface 41 comprises an actual machine operating mechanism 411, an actual machine image capturing device 412, and an actual machine state sensor group 414. The actual machine operating mechanism 411 comprises a plurality of operating levers disposed in the same manner as the remote operating mechanism 211, around the seat installed in the cab 424. Installed in the cab 424 is a driving mechanism or a robot that receives a signal corresponding to an operation state of a remote operating lever, and moves an actual machine operating lever based on the received signal. The actual machine image capturing device 412 is installed, for example, in the cab 424, and captures an image of the environment including at least a portion of the work mechanism 440, through a front window and a pair of left and right side windows. Some or the whole of the front window (or window frame) and the side windows may be omitted. The actual machine state sensor group 414 is constituted by angle sensors for measuring a pivoting angle (elevation angle) of the boom 441 with respect to the upper turning body 420, a pivoting angle of the arm 443 with respect to the boom 441, and a pivoting angle of the bucket 445 with respect to the arm 443, respectively, a turning angle sensor for measuring a turning angle of the upper turning body 420 with respect to the lower traveling body 410, an external force sensor for measuring an external force acting on the bucket 445, a three-axis acceleration sensor for measuring three-axis acceleration acting on the upper turning body 420, etc.

The actual machine output interface 42 comprises an actual machine image output device 421, and an actual machine wireless communication device 422. The actual machine image output device 421 is disposed, for example, in the vicinity of the front window in the cab 424 (see FIG. 6 and FIG. 9). The actual machine image output device 421 may be omitted.

The work mechanism 440 as an operating mechanism comprises the boom 441 attached to the upper turning body 420 so as to be able to elevate, the arm 443 pivotably connected to a distal end of the boom 441, and the bucket 445 pivotably connected to a distal end of the arm 443. Attached to the work mechanism 440 are the boom cylinder 442, the arm cylinder 444, and the bucket cylinder 446, each being constituted by an extendable hydraulic cylinder. As a work part, various attachments such as a nibbler, a cutter, and a magnet as well as the bucket 445 may be used.

The boom cylinder 442 is interposed between the boom 441 and the upper turning body 420 such that the boom cylinder 442 is extended and shortened by receiving a supply of hydraulic oil, and pivots the boom 441 in an elevating direction. The arm cylinder 444 is interposed between the arm 443 and the boom 441 such that the arm cylinder 444 is extended and shortened by receiving a supply of hydraulic oil, and pivots the arm 443 around a horizontal axis with respect to the boom 441. The bucket cylinder 446 is interposed between the bucket 445 and the arm 443 such that the bucket cylinder 446 is extended and shortened by receiving a supply of hydraulic oil, and pivots the bucket 445 around a horizontal axis with respect to the arm 443.

(First Function)

A first function of a remote operation assisting system constituted by the remote operation assistant server 10, the remote operation device 20 and the work machine 40 of the above configuration will be described using a flowchart shown in FIG. 4. In the flowchart, the blocks "C •" are used for simplifying the description, and mean transmission and/or reception of data, and mean conditional branches to execute processing in branch direction under the condition of transmitting and/or receiving the data.

Figure 4:
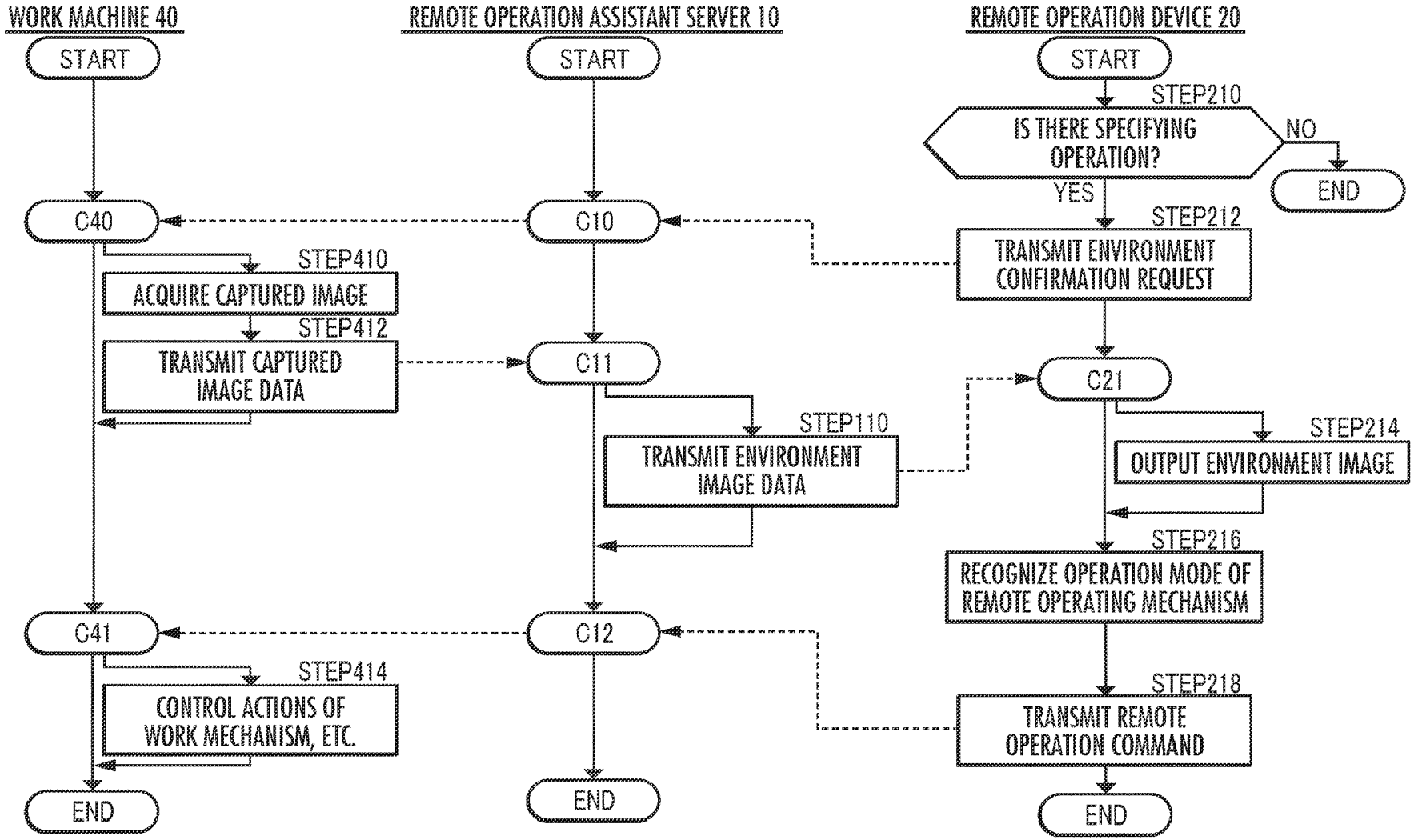
FIG. 4 is an explanatory view about a function of a remote operating system.

In the remote operation device 20, it is decided whether there is a specifying operation through the remote input interface 210 by an operator (STEP 210 in FIG. 4). The "specifying operation" is, for example, an operation, such as tapping the remote input interface 210 performed by the operator to specify the work machine 40 that the operator intends to remotely operate. If the result of the decision is no (NO in STEP 210 in FIG. 4), a sequence of processing is finished. On the other hand, if the result of the decision is yes (YES in STEP 210 in FIG. 4), an environment confirmation request is transmitted to the remote operation assistant server 10 through the remote wireless communication device 224 (STEP 212 in FIG. 4).

In the remote operation assistant server 10, when the environment confirmation request is received, the environment confirmation request is transmitted to the corresponding work machine 40 by the first assistant processing element 121 (C10 in FIG. 4).

In the work machine 40, when the environment confirmation request is received through the actual machine wireless communication device 422 (C40 in FIG. 4), the actual machine control device 400 acquires a captured image through the actual machine image capturing device 412 (STEP 410 in FIG. 4). Captured image data representing the captured image is transmitted through the actual machine wireless communication device 422 to the remote operation assistant server 10 by the actual machine control device 400 (STEP 412 in FIG. 4).

In the remote operation assistant server 10, when the captured image data is received by the first assistant processing element 121 (C11 in FIG. 4), environment image data corresponding to the captured image is transmitted to the remote operation device 20 by the second assistant processing element 122 (STEP 110 in FIG. 4). The environment image data is image data representing a simulated environment image generated based on the captured image, as well as the captured image data itself.

In the remote operation device 20, when the environment image data is received through the remote wireless communication device 224 (C21 in FIG. 4), an environment image corresponding to the environment image data is transmitted to the remote image output device 221 by the remote control device 200 (STEP 214 in FIG. 4).

Figure 6:
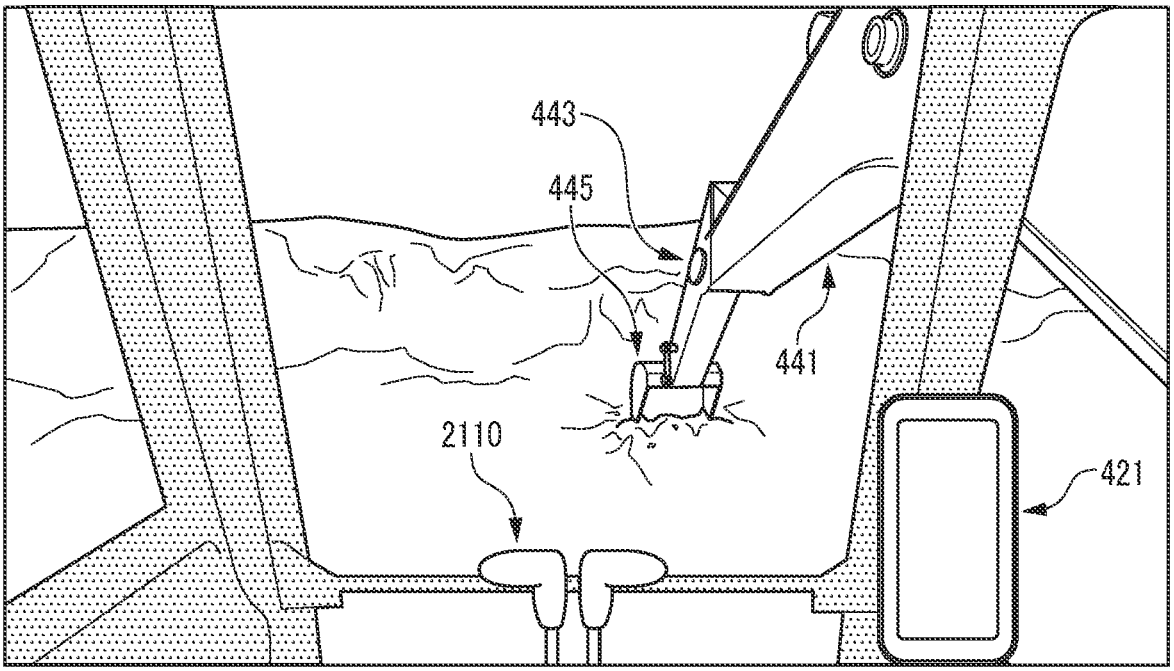
FIG. 6 is an explanatory view about a work environment image.

Consequently, for example, as shown in FIG. 6, the environment image in which the boom 441, the arm 443, and the bucket 445 as parts of the work mechanism 440 appear is output to the remote image output device 221.

In the remote operation device 20, an operation mode of the remote operating mechanism 211 is recognized by the remote control device 200 (STEP 216 in FIG. 4), and a remote operation command corresponding to the operation mode is transmitted to the remote operation assistant server 10 through the remote wireless communication device 224 (STEP 218 in FIG. 4).

In the remote operation assistant server 10, when the remote operation command is received by the second assistant processing element 122, the remote control operation command is transmitted to the work machine 40 by the first assistant processing element 121 (C12 in FIG. 4).

In the work machine 40, when the operation command is received by the actual machine control device 400 through the actual machine wireless communication device 422 (C41 in FIG. 4), actions of the work mechanism 440 are controlled (STEP 414 in FIG. 4). For example, work of scooping soil in front of the work machine 40 by the bucket 445, and dropping the soil from the bucket 445 after turning the upper turning body 420 is executed.

A second function of the remote operation assisting system of the above configuration (mainly the function of the actual machine state monitoring system 110 constituted by the remote operation assistant server 10) will be described using a flowchart shown in FIG. 5. In the flowchart, the blocks "C •" are used for simplifying the description, and mean transmission and/or reception of data, and mean conditional branches to execute processing in branch direction under the condition of transmitting and/or receiving the data.

Figure 5:
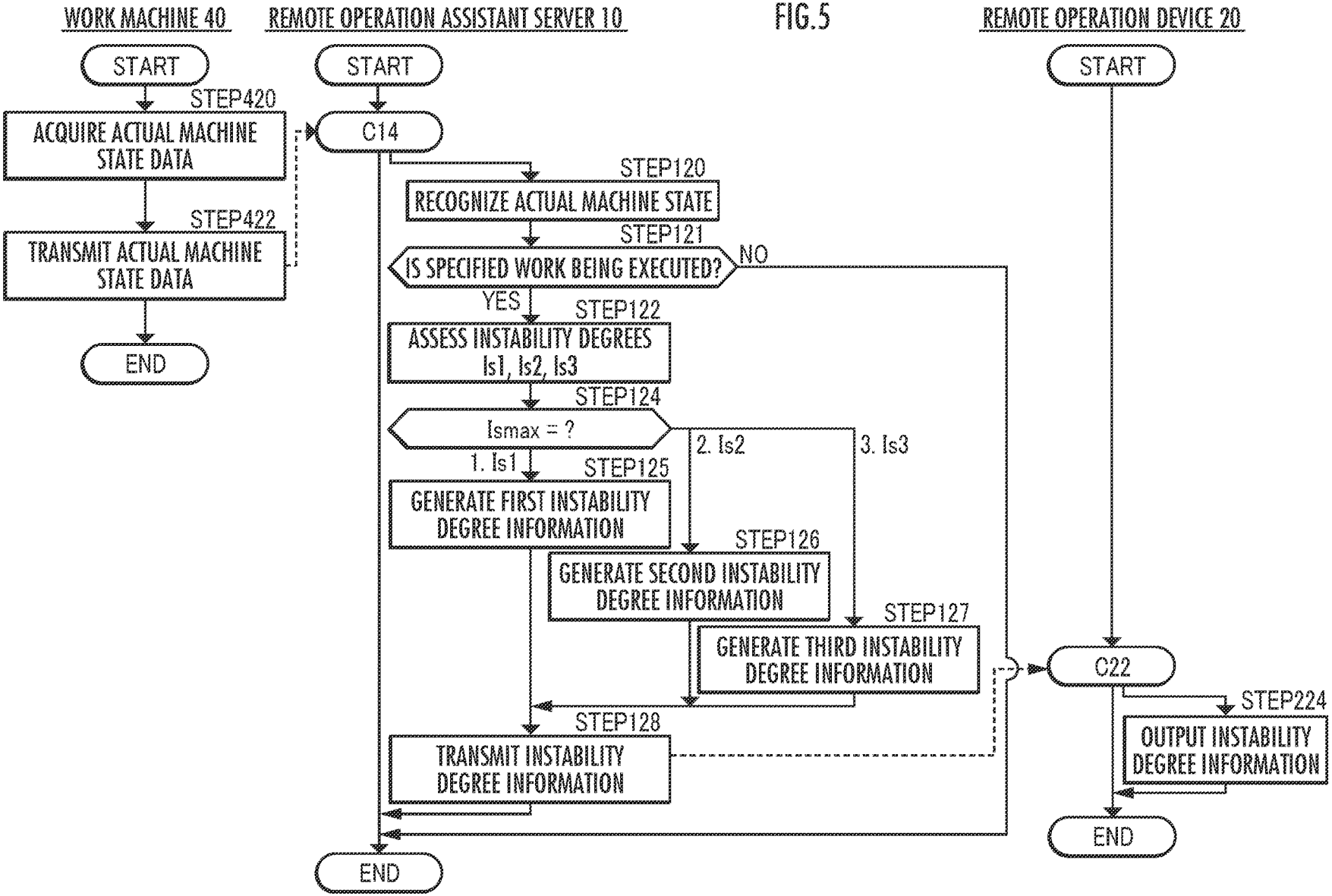
FIG. 5 is an explanatory view about a function of the actual machine state monitoring system.

In the work machine 40, actual machine state data representing an operation state of the work machine 40 is acquired by the actual machine control device 400, based on an output signal from the actual machine state sensor group 414 (STEP 420 in FIG. 5). The operation state of the work machine 40 includes the pivoting angle (elevation angle) of the boom 441 with respect to the upper turning body 420, the pivoting angle of the arm 443 with respect to the boom 441, the pivoting angle of the bucket 445 with respect to the arm 443, the turning angle of the upper turning body 420 with respect to the lower traveling body 410, and an external force F acting on the bucket 445, etc.

The actual machine state data is transmitted through the actual machine wireless communication device 422 to the remote operation assistant server 10 by the actual machine control device 400 (STEP 422 in FIG. 5).

In the remote operation assistant server 10, when the actual machine state data is received (C14 in FIG. 5), the state of the work machine 40 is recognized based on the actual machine state data by the actual machine state recognition element 111 (STEP 120 in FIG. 5).

More specifically, the time sequence of the external force F acting on the bucket 445 is recognized. The external force F may be recognized depending on at least one hydraulic pressure of the boom cylinder 442, the arm cylinder 444, and the bucket cylinder 446.

Moreover, in the actual machine coordinate system when the position and attitude with respect to the work machine 40 are fixed, each of coordinate values of a gravity center P0 of a base body constituted by the lower traveling body 410 and the upper turning body 420, a floating fulcrum point P1, and an external force action point P2 (distal end point of the bucket 445) is recognized. The coordinate values of the gravity center P0 of the base body in the actual machine coordinate system are classified by each type and/or specification of the work machine 40, and preregistered in the database 102. The coordinate values of the floating fulcrum point P1 in the actual machine coordinate system are recognized based on the turning angle of the upper turning body 420 with respect to the lower traveling body 410 (see a floating fulcrum point T1f in Patent Literature 1). The external force action point P2 in the actual machine coordinate system is geometrically recognized based on each of the pivoting angle (elevation angle) of the boom 441 with respect to the upper turning body 420, the pivoting angle of the arm 443 with respect to the boom 441, the pivoting angle of the bucket 445 with respect to the arm 443, and link lengths of the boom 441, the arm 443, and the bucket 445. Each of the link length of the boom 441 (the distance from a joint mechanism on the upper turning body 420 side to a joint mechanism on the arm 443 side), the link length of the arm 443 (the distance from a joint mechanism on the boom 441 side to a joint mechanism on the bucket 445 side), and the link length of the bucket 445 (the distance from a joint mechanism on the arm 443 side to the distal end of the bucket 445) is classified by each type and/or specification of the work machine 40, and preregistered in the database 102.

Whether or not the work machine 40 is executing specified work using the bucket 445 (work part) is decided by the actual machine state recognition element 111 (STEP 121 in FIG. 5). For example, if the specified work is digging work, whether or not the work machine 40 is executing the specified work is recognized, based on whether or not the external force F acting on the bucket 445 repetitively increases and decreases.

If the result of the decision is no (NO in STEP 121 in FIG. 5), a sequence of processing in this control cycle is finished. On the other hand, if the result of the decisions is yes (YES in STEP 121 in FIG. 5), a first instability degree Is1, a second instability degree Is2, and a third instability degree Is3 of the upper turning body 420 (base body) of the work machine 40 are assessed by the instability degree assessment element 112, based on the actual machine state recognized by the actual machine state recognition element 111 (STEP 122 in FIG. 5).

The first instability degree Is1 represents an instability degree defined from a viewpoint of instability of the base body due to floating up of the lower traveling body 410 (base body) of the work machine 40 from the ground. The first instability degree Is1 is given by a relational expression (11), based on the external force F, an angle $\theta_f$ formed by an external force vector with a horizontal plane, a distance $I_g$ between the gravity center P0 of the base body and the floating fulcrum point P1 located behind the gravity center P0, a distance $I_t$ between the floating fulcrum point P1 and the external force action point P2, an angle $\theta_g$ formed by a line segment P0-P1 (or a plane including the line segment P0-P1) with the horizontal plane, an angle $\theta_t$ formed by a line segment P1-P2 (or a plane including the line segment P1-P2) with the horizontal plane, a weight m of the base body, and gravitational acceleration g shown in FIG. 7. In short, the first instability degree Is1 is defined as a continuous function or a continuous dependent variable with continuous variables It, F, $\theta_f$, $\theta_t$, $I_g$, and $\theta_g$ as main variables.

$$Is1=I_t \cdot F \sin(\theta_t+\theta_f)/I_g \cdot mg \cos \theta_g \quad (11).$$

Figure 8:
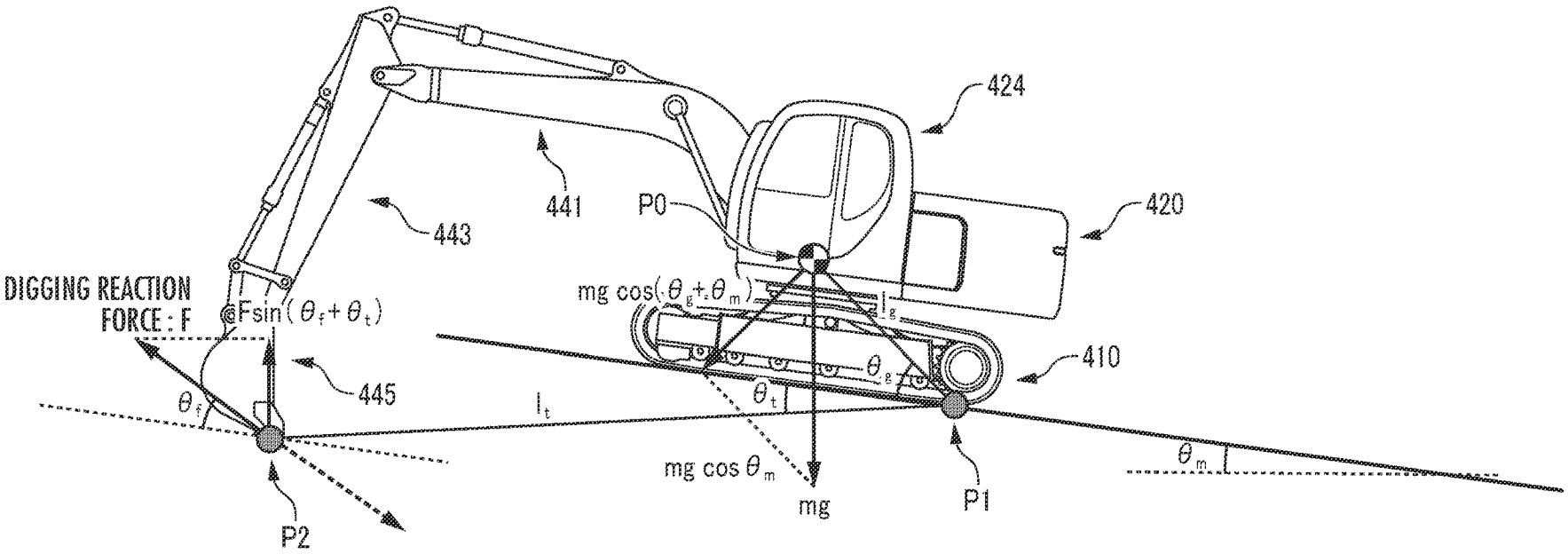
FIG. 8 is an explanatory view about an assessment method for the first instability degree when the ground is inclined.

As shown in FIG. 8, when the ground is inclined only by an angle $\theta_m$, the first instability degree Is1 is defined by a relational expression (21). The inclination angle $\theta_m$ of the ground is measurable based on output signals from the three-axis acceleration sensor that constitutes the actual machine state sensor group 414, and measures three-axis acceleration acting on the upper turning body 420.

$$Is1=I_t \cdot F \sin(\theta_t+\theta_f)/I_g \cdot mg \cos(\theta_g+\theta_m) \quad (21).$$

The second instability degree Is2 represents an instability degree defined from a viewpoint of instability of the base body due to floating up of the lower traveling body 410 (base body) of the work machine 40 from the ground. The second instability degree Is2 is given by a relational expression (12), based on the external force F, the angle $\theta_f$ formed by the external force vector with the horizontal plane, a distance $I_{fg}$ between the gravity center P0 of the base body and the floating fulcrum point P1 located in front of the gravity center P0, a distance $I_f$ between the floating fulcrum point P1 and the external force action point P2, an angle $\theta_{fg}$ formed by the line segment P0-P1 (or a plane including the line segment P0-P1) with the horizontal plane, an angle $\theta_f t$ formed by the line segment P1-P2 (or a plane including the line segment P1-P2) with the horizontal plane, the weight m of the base body, and the gravitational acceleration g shown in FIG. 9. In short, the second instability degree Is2 is defined as a continuous function or a continuous dependent variable with continuous variables $I_f$, F, $\theta_f$, $\theta_t$, $I_{fg}$, and $\theta_{fg}$ as main variables.

$$Is2=I_{fi} \cdot F \sin(\theta_f-\theta_f t)/I_{fg} \cdot mg \cos \theta_{fg} \quad (12).$$

Figure 10:
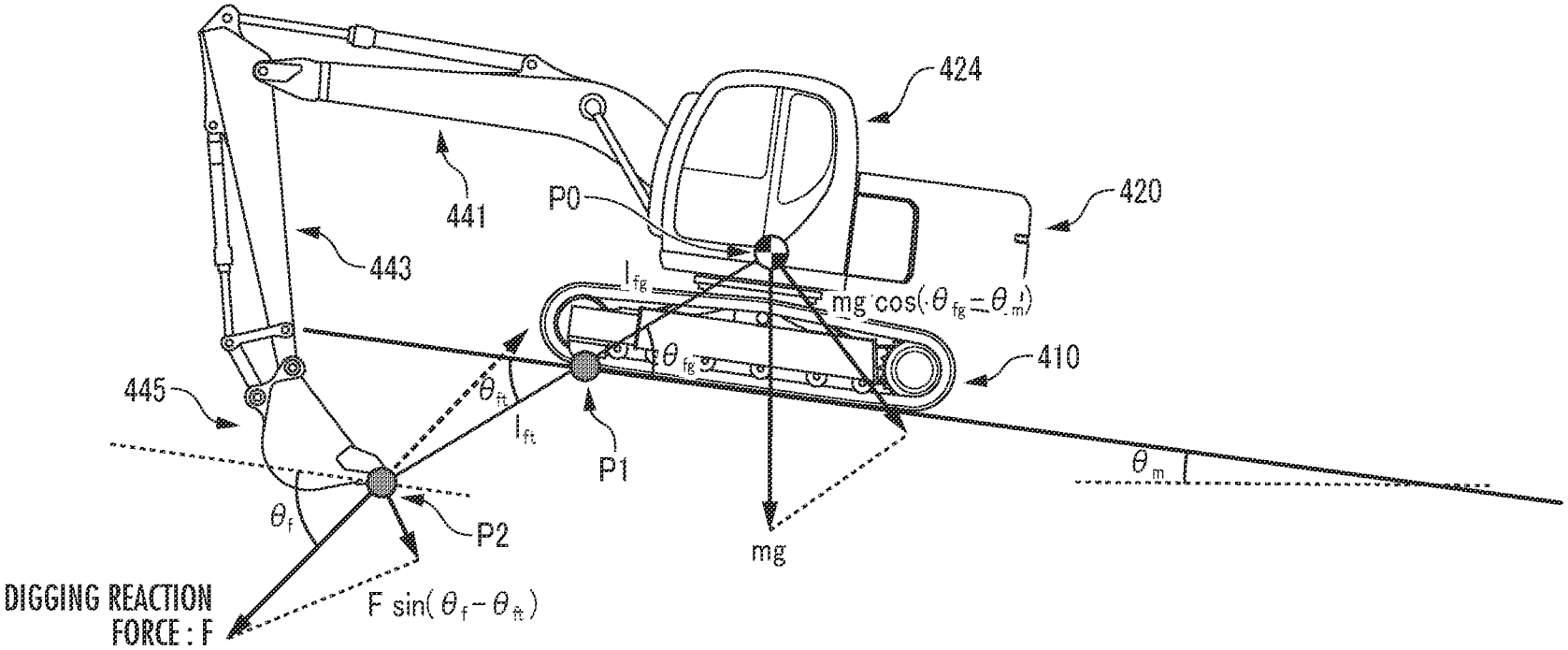
FIG. 10 is an explanatory view about an assessment method for the second instability degree when the ground is inclined.

As shown in FIG. 10, when the ground is inclined only by the angle $\theta_m$, the second instability degree Is2 is defined by a relational expression (22).

$$Is2=I_{fi} \cdot F \sin(\theta_f-\theta_f t)/I_{fg} \cdot mg \cos(\theta_{fg}+\theta_m) \quad (22).$$

Figure 11:
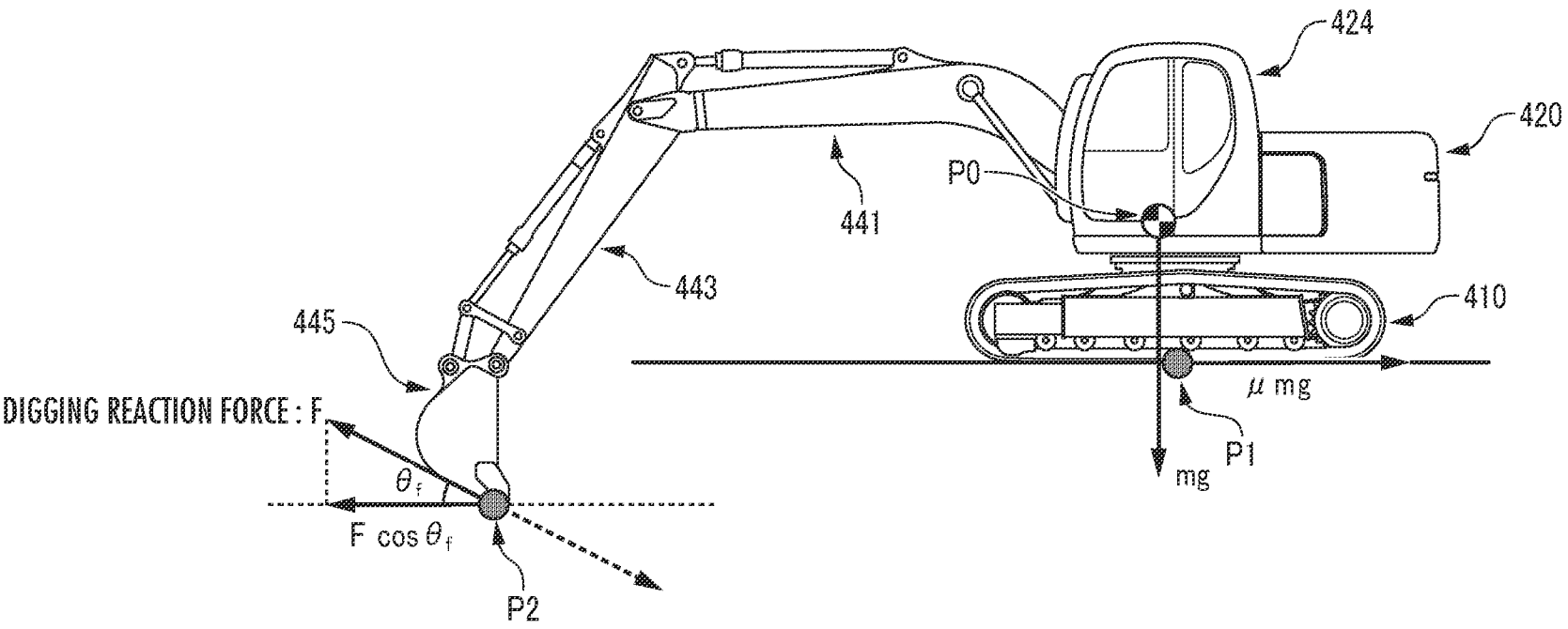
FIG. 11 is an explanatory view about an assessment method for a third instability degree when the ground is flat.

The third instability degree Is3 represents an instability degree defined from a viewpoint of instability of the base body caused when the lower traveling body 410 (base body) of the work machine 40 slides with respect to the ground. The third instability degree Is3 is given by a relational expression (13), based on the external force F, the angle $\theta_f$ formed by the external force vector with the horizontal plane, the weight m of the base body, the gravitational acceleration g, and a static friction coefficient (or dynamic friction coefficient) between the base body and the ground shown in FIG. 11. In short, the third instability degree Is3 is defined as a continuous function or a continuous dependent variable with continuous variables F and $\theta_f$ as main variables. It should be noted that, for the static friction coefficient μ, a standard value at the work site is used, but different values may be used depending on different meteorological conditions (precipitation, temperature, humidity, etc.), and/or soil conditions and ground conditions (dirt, clay, gravel, sand, debris, etc.).

$$Is3=F \cos \theta_f/mg \quad (13).$$

Figure 12:
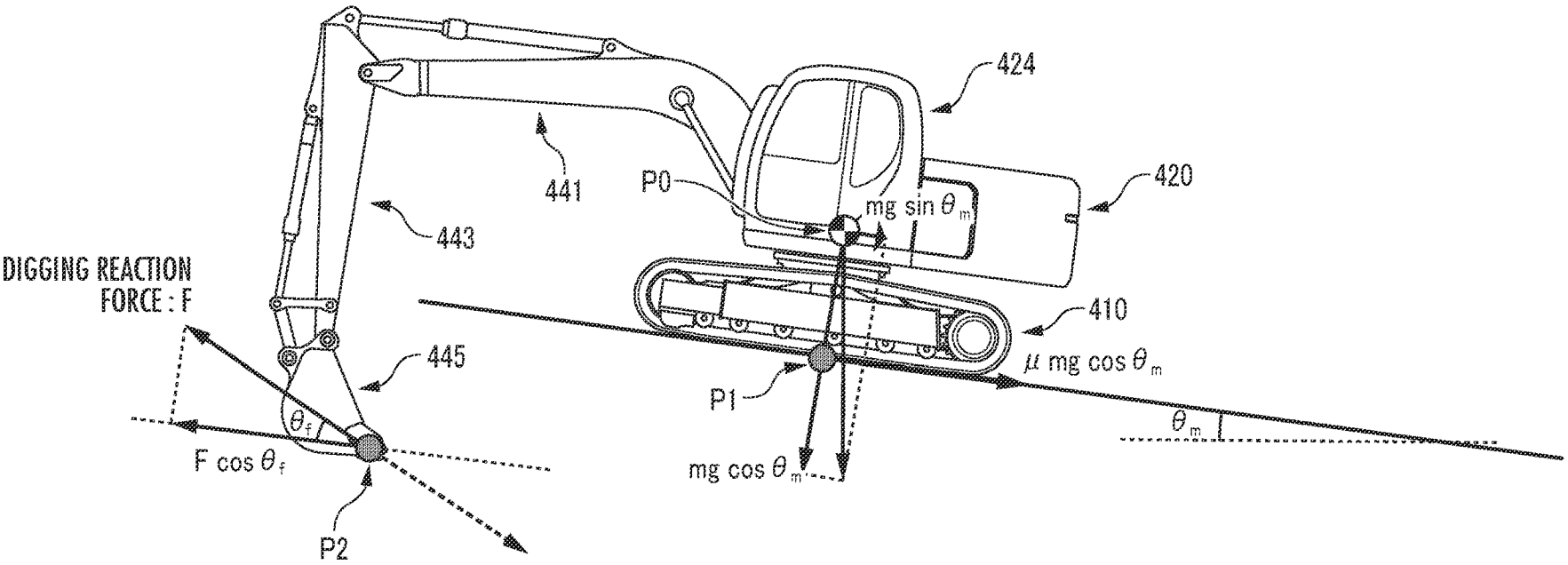
FIG. 12 is an explanatory view about an assessment method for the third instability degree when the ground is inclined.

As shown in FIG. 12, when the ground is inclined only by an angle $\theta_m$, the third instability degree Is3 is defined by a relational expression (23).

$$Is3=F \cos \theta_f/(\mu mg \cos \theta_m-mg \sin\theta_m) \quad (23).$$

Which of the first instability degree Is1, the second instability degree Is2, and the third instability degree Is3 is maximum is decided by the output control element 114 (STEP 124 in FIG. 5).

If it is decided that the first instability degree Is1 is maximum instability Ismax (1 in STEP 124 in FIG. 5), first instability degree information indicating the first instability degree Is1 is generated by the output control element 114 (STEP 125 in FIG. 5). If it is decided that the second instability degree Is2 is maximum instability Ismax (2 in STEP 124 in FIG. 5), second instability degree information indicating the second instability degree Is2 is generated by the output control element 114 (STEP 126 in FIG. 5). If it is decided that the third instability degree Is3 is maximum instability Ismax (3 in STEP 124 in FIG. 5), third instability degree information indicating the third instability degree Is3 is generated by the output control element 114 (STEP 127 in FIG. 5). Then, the first instability degree information, the second instability degree information, or the third instability degree information is transmitted to the remote operation device 20 by the output control element 114 (STEP 128 in FIG. 5).

In the remote operation device 20, when the first instability degree information, the second instability degree information, or the third instability degree information is received by the remote wireless communication device 224 (C22 in FIG. 5), the instability degree information is output to the remote image output device 221 by the remote control device 200 (STEP 224 in FIG. 5).

Figure 13:
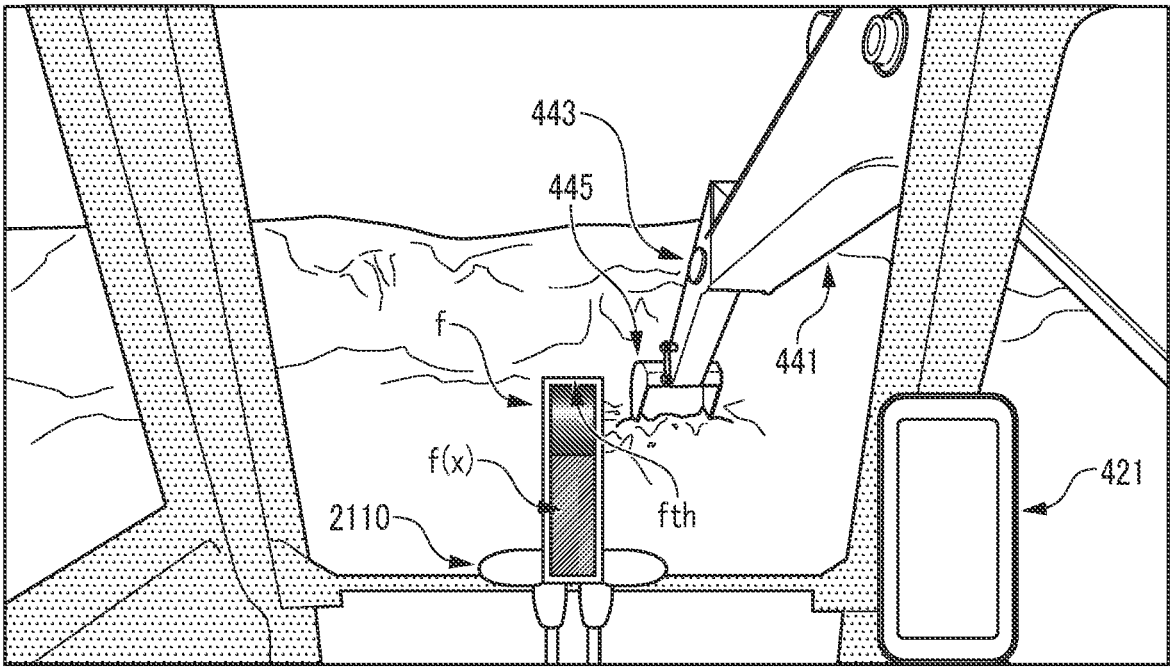
FIG. 13 is an explanatory view about the form of output of instability degree information.

Consequently, as shown in FIG. 13, for example, a diagram f(x) or bar graph in which the length from a lower edge of a window f varies depending on the level of the instability degree is output to the window f in a superimposed manner on the environment image on the remote image output device 221. The size of the diagram f(x) is defined by an increasing function, such as a linear function, an exponential function, and a logarithmic function, with the instability degree as a variable. A scale division at or below the top edge of the window f represents a threshold value fth at which the base body floats up from the ground, or the base body slides with respect to the ground, when the first instability degree Is1, the second instability degree Is2, or the third instability degree Is3 reaches the threshold value fth.

The diagram f(x) may take various shapes such as a circular shape, a circular-sector shape, and a rhombus shape, as well as a rectangular shape. The size, shape, color (lightness, saturation and hue) or pattern, or an arbitrary combination thereof of the diagram f(x) may be output so as to vary continuously depending on a continuous change in the instability degree Is1, Is2, Is3.

Effects

Figure 9:
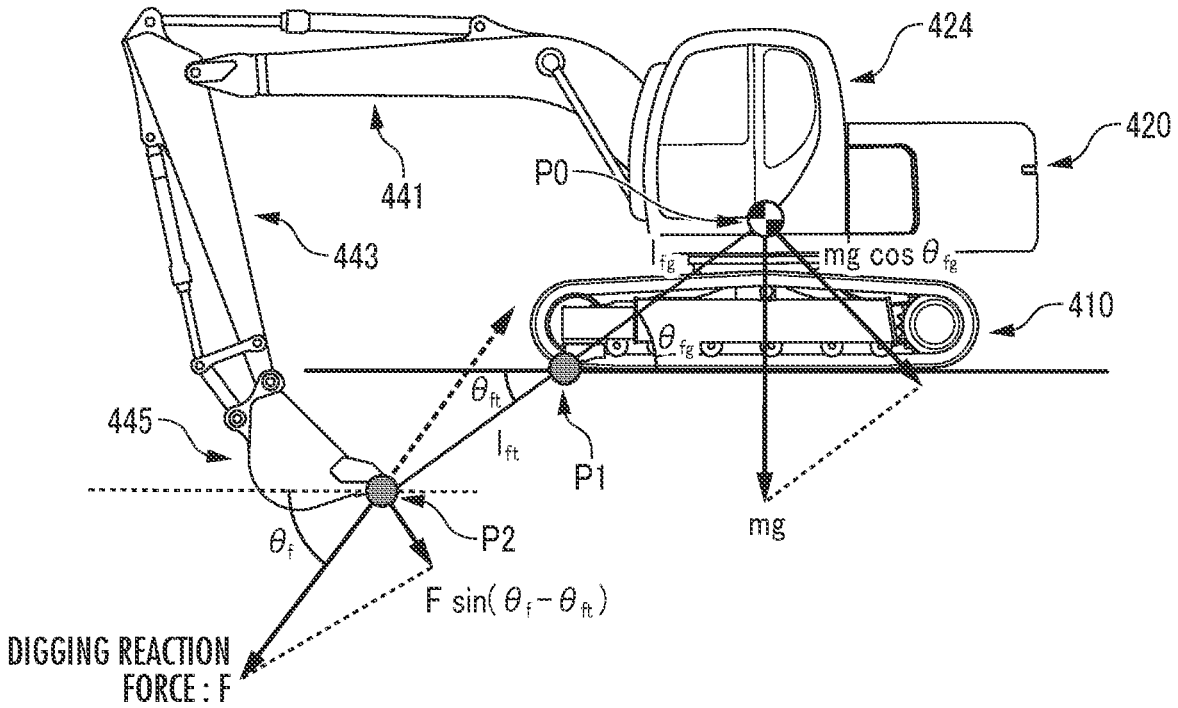
FIG. 9 is an explanatory view about an assessment method for a second instability degree when the ground is flat.

According to the actual machine state monitoring system 110 constituting the remote operation assisting system of this configuration, the instability degree information indicating the values of instability degrees Is1, Is2, Is3 of the base body (the lower traveling body 410 and the upper turning body 420) assessed as continuous variables is output to the remote image output device 221 (information output device) such that the form of the output varies continuously depending on continuous changes in the instability degrees Is1, Is2, Is3 (see STEP 122 to STEP 224 in FIG. 5, and FIG. 9).

Therefore, it is possible to enable the operator of the work machine 40 to highly accurately recognize the closeness of the current instability degree of the base body to the threshold value at which the base body becomes unstable, and consequently a tolerable range in which the work mechanism, etc. are operated while avoiding instability of the base body.

Figure 7:
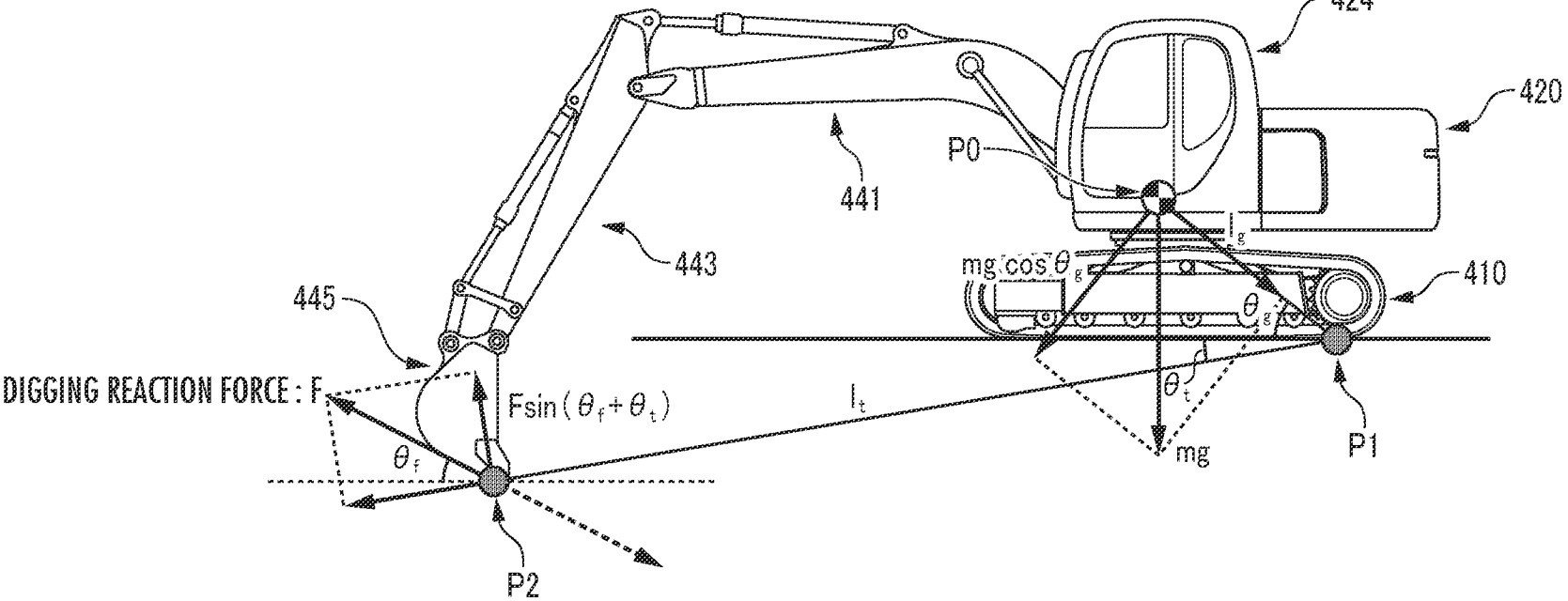
FIG. 7 is an explanatory view about an assessment method for a first instability degree when the ground is flat.

Through the instability degree information (first instability degree information) indicating the first instability degree output by the information output device, it is possible to enable the operator of the work machine to highly accurately recognize the closeness of the first instability degree of the base body to the threshold value (first threshold value), and consequently a tolerable range in which the work mechanism, etc. are operated while avoiding instability of the base body due to floating up from the ground with the floating fulcrum P1 located behind the gravity center P0 as the start point (see FIG. 7, HG, 8, and FIG. 13). Similarly, through the instability degree information (second instability degree information) indicating the second instability degree output by the information output device, it is possible to enable the operator of the work machine to highly accurately recognize the closeness of the second instability degree of the base body to the threshold value (second threshold value), and consequently a tolerable range in which the work mechanism, etc. are operated while avoiding instability of the base body due to floating up from the ground with the floating fulcrum P1 located in front of the gravity center P0 as the start point (see FIG. 9, HG, 10, and FIG. 13). Through the instability degree information (third instability degree information) indicating the third instability degree output by the information output device, it is possible to enable the operator of the work machine to highly accurately recognize the closeness of the instability degree of the base body to the threshold value (third threshold value), and consequently a tolerable range in which the work mechanism, etc. are operated while avoiding instability of the base body due to sliding with respect to the ground (see FIG. 11, FIG. 12, and FIG. 13).

Moreover, only in a situation in which the work machine 40 is executing digging work as specified work while causing the bucket 445 (work part) to apply a force onto a work object (such as dirt and rubble), i.e., a situation in which the base body is likely to be unstable, the instability degree information is transmitted through the information output device to the operator (see YES in STEP 121 to STEP 224 in FIG. 5). Consequently, the usefulness of the instability degree information is improved.

Another Embodiment of Present Invention

In the above embodiment, the actual machine state monitoring system 110 is constituted by the remote operation assistant server 10, but the actual machine state monitoring system 110 may be constituted by the remote operation device 20 and/or the work machine 40 as another embodiment. In other words, the remote operation device 20 and/or the work machine 40 may have functions as the actual machine state recognition element 111, the instability degree assessment element 112, and the output control element 114.

In the above embodiment, the instability degree information is output through the remote image output device 221, but the instability degree information may be additionally or alternatively output through the sound output device 222 and/or the vibration output device 223. A sound indicating the instability degree of the base body may be output by the sound output device 222 such that volume, frequency, or a combination of the volume and frequency of the sound varies continuously. A vibration indicating the instability degree of the base body may be output by the vibration output device 223 such that amplitude, vibration frequency, or a combination of the amplitude and vibration frequency of the vibration varies continuously.

In the above embodiment, the first instability degree Is1, the second instability degree Is2 and the third instability degree Is3 are assessed (see STEP 122 in FIG. 5, and FIG. 7 to FIG. 12), but, as another embodiment, only one of the first instability degree Is1, the second instability degree Is2 and the third instability degree Is3 may be assessed, and instability degree information indicating the one instability degree may be transmitted to the information output device. The average value or the weighted sum of at least two of the first instability degree Is1, the second instability degree Is2 and the third instability degree Is3 may be assessed as a single instability degree.

In the above embodiment, only the instability degree information indicating one of the first instability degree Is1, the second instability degree Is2 and the third instability degree Is3 is output to the information output device (see 1 in STEP 124→STEP 125→STEP 128→ . . . →STEP 224 in FIG. 5, 2 in STEP 124→STEP 126→STEP 128→ . . . →STEP 224 in FIGS. 5, and 3 in STEP 124→STEP 126→STEP 127→ . . . STEP 224 in FIG. 5), but three or two pieces of instability degree information indicating all or two of the first instability degree Is1, the second instability degree Is2 and the third instability degree Is3 may be output to the information output device. In this case, two diagrams f(x) for showing each of the first instability degree Is1, the second instability degree Is2 and the third instability degree Is3 may be output. Specific processing of the maximum instability degree Ismax (see STEP 124 in FIG. 5) is omitted.

In the above embodiment, the instability degree information is transmitted through the information output device to the operator only in a situation in which the work machine 40 is executing specified work (for example, digging work) using the bucket 445 (work part) (see YES in STEP 121→ . . . STEP 244 in FIG. 5), but, as another embodiment, the instability degree information may be transmitted through the information output device to the operator, irrespective of whether or not the work machine 40 is executing specified work.

In the actual machine state monitoring system, the instability degree assessment element preferably assesses at least one of the first instability degree which is assessed using a criterion that the base body does not float up from the ground, and the second instability degree which is assessed using a criterion that the base body does not slide with respect to the ground.

According to the actual machine state monitoring system of this configuration, it is possible to enable the operator of the work machine to highly accurately recognize, through the instability degree information (first instability degree information) indicating the first instability degree output by the information output device, the closeness of the first instability degree of the base body to the threshold value (first threshold value), and consequently a tolerable range in which the work mechanism, etc. are operated while avoiding instability of the base body due to floating up from the ground. Similarly, it is possible to enable the operator of the work machine to highly accurately recognize, through the instability degree information (second instability degree information) indicating the second instability degree output by the information output device, the closeness of the instability degree of the base body to the threshold value (second threshold value), and consequently a tolerable range in which the work mechanism, etc. are operated while avoiding instability of the base body due to sliding with respect to the ground.

In the actual machine state monitoring system of the present invention, it is preferred that the actual machine state recognition element recognize whether or not the work machine is executing specified work while the work machine causes the work part to apply a force onto a work object, and that the output control element cause the information output device to output the instability degree information on condition that the actual machine state recognition element recognizes that the work machine is executing the specified work.

According to the actual machine state monitoring system of this configuration, only in a situation in which the work machine is executing specified work while causing the work part to apply a force onto a work object, i.e., a situation in which the base body is likely to be unstable, the instability degree information is transmitted through the information output device to the operator.

Consequently, the usefulness of the instability degree information is improved.

REFERENCE SIGNS LIST

10 . . . remote operation assistant server, 20 . . . remote operation device, 200 . . . remote control device, 40 . . . work machine, 210 . . . remote input interface, 211 . . . remote operating mechanism, 220 . . . remote output interface, 221 . . . remote image output device (information output device), 222 . . . sound output device (information output device), 223 . . . vibration output device (information output device), 224 . . . remote wireless communication device, 41 . . . actual machine input interface, 412 . . . actual machine image capturing device, 414 . . . actual machine state sensor group, 42 . . . actual machine output interface, 421 . . . actual machine image output device (information output device), 422 . . . actual machine wireless communication device, 440 . . . work mechanism (work attachment), 445 . . . bucket (work part), 110 . . . actual machine state monitoring system, 111 . . . actual machine state recognition element, 112 . . . instability degree assessment element, 114 . . . output control element, 410 . . . lower traveling body (base body), Is1 . . . first instability degree, Is2 . . . second instability degree, Is3 . . . third instability degree.

The invention claimed is:

1. A machine state monitoring system for causing an information output device to transmit a state of a work machine to an operator of the work machine, the work machine having a base body, a work mechanism extending from the base body, and a work part attached to a distal end of the work mechanism, the machine state monitoring system comprising: a machine state recognition element which recognizes an attitude of the base body, and an external force acting on the work part; an instability degree assessment element which assesses one of a first instability degree, which is assessed using a criterion that the base body does not float up from the ground, and a second instability degree, which is assess using a criterion that the base body does not slide with respect to the ground; and an output control element which causes the information output device to output instability degree information such that a form of output of the instability degree information varies continuously depending on a continuous change in the larger of the first instability degree and the second instability degree, the instability degree information indicating the larger of the first instability degree and the second instability degree of the base body assessed by the instability degree assessment element; wherein the output control element causes an image output device constituting the information output device to output a diagram showing the instability degree of the base body such that a form of the diagram varies continuously based on a threshold value of the instability degree as a criterion.

2. The machine state monitoring system according to claim 1, wherein the first instability contains one of first instability degree which is assessed using a criterion that a front side of the base body does not float up from the ground, and another of instability degree which is assesses using a criterion that a back side of the base body does not float up from the ground, and the output control element causes the information output device to output instability degree information such that a form of output of the instability degree information varies continuously depending on a continuous change in the largest instability degree of one of the first instability degree, another of the first instability degree, and the second instability degree, the instability degree information indicating selectively the largest instability degree of the base body assessed by the instability degree assessment element.

3. The machine state monitoring system according to claim 1, wherein the output control element causes a sound output device constituting the information output device to output a sound indicating the instability degree of the base body such that volume, frequency, or a combination of the volume and frequency of the sound varies continuously.

4. The machine state monitoring system according to claim 1, wherein the output control element causes a vibration output device constituting the information output device to output a vibration indicating the instability degree of the base body such that amplitude, vibration frequency, or a combination of the amplitude and vibration frequency of the vibration varies continuously.

5. The machine state monitoring system according to claim 1, wherein the machine state recognition element recognizes whether or not the work machine is executing specified work while the work machine causes the work part to apply a force onto a work object, and the output control element causes the information output device to output the instability degree information on condition that the machine state recognition element recognizes that the work machine is executing the specified work.

6. The machine state monitoring system according to claim 1, wherein the machine state monitoring system is constituted by a remote operation assistant server for assisting, based on communications with each of the work machine and a remote operation device for remotely operating the work machine, a remote operation of the work machine by the remote operation device.

7. The machine state monitoring system according to claim 1, wherein the information output device is constituted by a remote operation device for remotely operating the work machine.

8. A machine state monitoring method for causing an information output device to transmit a state of a work machine to an operator of the work machine, the work machine having a base body, a work mechanism extending from the base body, and a work part attached to a distal end of the work mechanism, the machine state monitoring method comprising: a machine state recognition element which recognizes an attitude of the base body, and an external force acting on the work part; an instability degree assessment element which assesses one of a first instability degree, which is assessed using a criterion that the base body does not float up from the ground, and a second instability degree, which is assess using a criterion that the base body does not slide with respect to the ground; and an output control element which causes the information output device to output instability degree information such that a form of output of the instability degree information varies continuously depending on a continuous change in the larger of the first instability degree and the second instability degree, the instability degree information indicating the larger of the first instability degree and the second instability degree of the base body assessed by the instability degree assessment element; wherein the output control element causes an image output device constituting the information output device to output a diagram showing the instability degree of the base body such that a form of the diagram varies continuously based on a threshold value of the instability degree as a criterion.

* * * * *